US005085732A

United States Patent [19]

Nakamura et al.

[11] Patent Number: 5,085,732

[45] Date of Patent: Feb. 4, 1992

[54] METHOD FOR REMOVING A SELENIUM-CONTAINING LAYER FROM A ELECTROPHOTOGRAPHIC PHOTORECEPTOR

[75] Inventors: Mitsuhide Nakamura; Shiro Kimura, both of Kanagawa, Japan

[73] Assignee: Fuji Xerox Co., Ltd., Tokyo, Japan

[21] Appl. No.: 409,681

[22] Filed: Sep. 20, 1989

[30] Foreign Application Priority Data

Sep. 26, 1988 [JP] Japan ..... 63-238875

[51] Int. Cl.[5] ..... C23F 1/00

[52] U.S. Cl. ..... 156/656; 156/664; 252/79.1; 134/3; 134/38

[58] Field of Search ..... 134/3, 38; 252/79.1; 423/510; 156/656, 664

[56] References Cited

U.S. PATENT DOCUMENTS 4,026,797 5/1977 Nikolic et al. ..... 210/50

FOREIGN PATENT DOCUMENTS 53-147703 12/1978 Japan .
55-149949 11/1980 Japan .
58-217412 12/1983 Japan .
59-18104 1/1984 Japan .
548163 9/1942 United Kingdom .
755784 8/1956 United Kingdom .
957366 5/1964 United Kingdom .
1068267 5/1967 United Kingdom .
1257177 12/1967 United Kingdom .
1151649 5/1969 United Kingdom .
1300442 12/1972 United Kingdom .
1438339 6/1976 United Kingdom .
1603160 11/1981 United Kingdom .
2017762 9/1989 United Kingdom .

*Primary Examiner*—David A. Simmons
*Assistant Examiner*—Thi Dang
*Attorney, Agent, or Firm*—Finnegan, Henderson, Farabow, Garrett and Dunner

[57] ABSTRACT

A method for removing an amorphous selenium-containing photosensitive layer from an electrophotographic photoreceptor including an electroconductive metallic substrate having thereon the amorphous selenium-containing photo-sensitive layer using a method in which the combination of substrate and selenium-containing photosensitive layer is treated with an aqueous solution of sodium sulfide or sodium thiourea.

4 Claims, No Drawings

METHOD FOR REMOVING A SELENIUM-CONTAINING LAYER FROM A ELECTROPHOTOGRAPHIC PHOTORECEPTOR

FIELD OF THE INVENTION

The present invention relates to a method for removing an amorphous selenium-containing photosensitive layer from an electrophotographic photoreceptor comprising an electroconductive metallic substrate having thereon the amorphous selenium-containing photosensitive layer.

BACKGROUND OF THE INVENTION

Electrophotographic copying machines employing electrophotographic photoreceptors have become remarkably in demand and have been used widely in recent years, resulting in an increase in the numbers of discarded electrophotographic machines. The electrophotographic photoreceptor employed in such a discarded electrophotographic machine comprises usually an amorphous selenium-containing photosensitive layer which is vapor-deposited on an electroconductive metallic substrate such as an aluminum drum. Since surface smoothness and dimensional accuracy, and resultant high cost, are required for electroconductive metallic substrates, especially drum-shaped substrates, it is advantageous to reuse these substrates without discarding them.

Various methods have hitherto been disclosed for separating an amorphous selenium-containing photosensitive layer from a metallic substrate of an electrophotographic photoreceptor; for example, (1) cutting the amorphous selenium-containing photosensitive layer, (2) repetition of heating and cooling to cause exfoliation by the difference of thermal expansion between the selenium layer and the metallic substrate, (3) exfoliation by high-pressure hot water ejected from a nozzle (see JP-A-59-18104 (The term "JP-A" as used herein means an "unexamined published Japanese patent application)), (4) heating under vacuum to evaporate selenium (See JP-A-55-149949), and (5) heat-treating the amorphous selenium-containing photosensitive layer and then treating with a chemical under heating (See JP-A-58-217412 and JP-A-53-147703).

Each of these known methods, however, has residual problems. For example, the methods (1) to (4) may evolve selenium dust suspending in the air or may emit vapor of oxides of As or Te which is contained in selenium oxides or selenium, causing harm to persons and other organisms and requiring apparatuses and equipment for recovering the harmful matters. Moreover, these methods suffer from the disadvantages such that the surface after removal of the amorphous selenium-containing photosensitive layer may become roughened or the surface thereof may be deformed by internal stress resulting from the action of heat. The method (5) also involves the disadvantages that 1) a remarkably high temperature is required for the treatment of the amorphous selenium-containing photosensitive layer for achieving satisfactory exfoliation; 2) a toxic substance may be formed by reaction of selenium with the reagent; or 3) the metallic substrate may be damaged by the reagent.

SUMMARY OF THE INVENTION

The present invention is based on the discovery of the properties of aqueous solution of sodium sulfide or sodium thiourea. The inventors have found these compounds to be capable of removing selenium.

The object of the present invention is to provide a method for removing an amorphous selenium-containing photosensitive layer from an electroconductive metallic substrate safely, quickly and inexpensively without damaging or deforming the surface thereof, under a relatively mild low-temperature condition.

According to an aspect of the present invention, there is provided a method for removing an amorphous selenium-containing photosensitive layer from an electrophotographic photoreceptor comprising an electroconductive metallic substrate having thereon the amorphous selenium-containing photosensitive layer, wherein said electrophotographic photoreceptor is treated with an aqueous solution of sodium sulfide or sodium thiourea.

DETAILED DESCRIPTION OF THE INVENTION

Inasmuch as the method works for different geometries of substrate and layers, no drawing is believed to be necessary.

The electrophotographic photoreceptor to be treated in the present invention comprises an amorphous selenium-containing photosensitive layer provided on an electroconductive metallic substrate. The electroconductive metallic substrate may be made of any material if it is resistant to the corrosion by sodium sulfide or sodium thiourea: the examples of the substrate material include aluminum, brass, chromium, stainless steel, etc. The substrate may be in any shape. A drum-shaped substrate is applied especially effectively according to the present invention. The amorphous selenium-containing photosensitive layer provided on the electroconductive metallic substrate is exemplified by a vapor-deposited Se-As layer, a vapor-deposited Se-Te layer, etc. as well as the vapor-deposited selenium layer.

In practicing the present invention, if the electrophotographic photoreceptor has a surface layer, the surface layer is preferably removed preliminarily, for example, by solvent treatment, and subsequently washed with water or other organic solvent such as alcohol, if desired.

In the present invention, an electrophotographic photoreceptor is treated with an aqueous solution of sodium sulfide or sodium thiourea, whereby the selenium in the amorphous selenium-containing photosensitive layer undergoes an addition reaction with sulfur, resulting in removal of the amorphous selenium-containing photosensitive layer from the electroconductive metallic substrate, even when it also contains As or Te.

The concentration of aqueous solution of sodium sulfide or sodium thiourea is preferably from 5 to 50 wt % and more preferably from 10 to 20 wt %.

If the concentration of the aqueous solution is less than 5 wt %, the reaction rate is retarded. If the concentration of the aqueous solution is more than 50 wt %, the surface of the substrate (e.g., aluminum substrate) is corroded.

In practicing the treatment, the above-mentioned aqueous solution may be sprayed and applied on the amorphous selenium-containing photosensitive layer, for example, by a sprayer, or otherwise the electrophotographic photoreceptor may be immersed in the above-mentioned aqueous solution. Particularly, the immersion treatment is preferred. In spray application, the aqueous solution of sodium sulfide or sodium thiourea is maintained at a temperature of 25° to 65° C. and may be sprayed at a pressure of 0.5 to 20 kg/cm$^2$. In immersion treatment, the electrophotographic photoreceptor may be immersed into the above-mentioned aqueous solution maintained at 35° to 65° C. (preferably 45° to 55° C.), and if the temperature is more than 65° C., the amount of evaporated solution is increased and thereby the surface of the substrate is roughed. If the temperature is less than 35° C., the reaction rate is retarded. The time for the treatment depends upon the concentration of the aqueous solution of sodium sulfide or sodium thiourea, but usually several minutes to 30 minutes is enough for removing the amorphous selenium-containing photosensitive layer. For example, in the Se-As type photosensitive layer, the treatment time is preferably from 5 to 10 minutes and in the Se-Te type photosensitive layer, the treatment time is preferably from 15 to 30 minutes.

After removal of the amorphous selenium-containing photosensitive layer from the electrophotographic photoreceptor by treatment with the above-mentioned aqueous solution, the recovered electroconductive metallic substrate is subjected to post-treatment, if desired, such as water-washing treatment, acid-treatment, and Freon treatment.

The examples below are intended to illustrate specifically the present invention.

EXAMPLE 1

An electrophotographic photoreceptor comprising an electroconductive metallic substrate composed of aluminum and an amorphous selenium-containing photosensitive layer provided thereon was immersed into a 10 wt % aqueous solution of sodium sulfide maintained at 60° C. The amorphous selenium-containing photosensitive layer was completely removed from the electroconductive metallic substrate by treatment for three minutes in the case of the amorphous selenium-containing photosensitive layer constituted of Se-Te alloy, and by treatment for 10 minutes in the case of the amorphous selenium-containing photosensitive layer constituted of Se-As alloy. Subsequently, the electroconductive metallic substrate was washed successively with water and diluted nitric acid solution, and further water, and then dried. Neither roughning nor deformation of the surface of the recovered electroconductive metallic substrate was observed.

EXAMPLE 2

An electrophotographic photoreceptor comprising an electroconductive metallic substrate composed of aluminum and an amorphous selenium-containing photosensitive layer provided thereon was immersed into a 20 wt % aqueous solution of sodium sulfide maintained at 60° C. The amorphous selenium-containing photosensitive layer was completely removed from the electroconductive metallic substrate by treatment for two minutes in the case of the amorphous selenium-containing photosensitive layer constituted of Se-Te alloy, and by treatment for five minutes in the case of the amorphous selenium-containing photosensitive layer constituted of Se-As alloy. Subsequently, the electroconductive metallic substrate was washed successively with water and diluted nitric acid solution, and further water, and then dried. Neither roughening nor deformation of the surface of the recovered electroconductive metallic substrate was observed.

EXAMPLE 3

An electrophotographic photoreceptor comprising an electroconductive metallic substrate composed of aluminum and an amorphous selenium-containing photosensitive layer provided thereon was immersed into a 20 wt % aqueous solution of sodium sulfide maintained at 30° C. The amorphous selenium-containing photosensitive layer was completely removed from the electroconductive metallic substrate by treatment for eight minutes in the case of the amorphous selenium-containing photosensitive layer constituted of Se-Te alloy, and by treatment for 25 minutes in the case of the amorphous selenium-containing photosensitive layer constituted of Se-As alloy. Subsequently, the electroconductive metallic substrate was washed successively with water and diluted nitric acid solution, and further water, and then dried. Neither roughening nor deformation of the surface of the recovered electroconductive metallic substrate was observed.

EXAMPLE 4

An electrophotographic photoreceptor comprising an electroconductive metallic substrate composed of aluminum and an amorphous selenium-containing photosensitive layer provided thereon was immersed into a 10 wt % aqueous solution of sodium thiourea maintained at 60° C. The amorphous selenium-containing photosensitive layer was completely removed from the electroconductive metallic substrate by treatment for 30 minutes in the case of the amorphous selenium-containing photosensitive layer constituted of Se-Te alloy, and by treatment for 15 minutes in the case of the amorphous selenium-containing photosensitive layer constituted of Se-As alloy. Subsequently, the electroconductive metallic substrate was washed successively with water and diluted nitric acid solution, and further water, and then dried. Neither roughening nor deformation of the surface of the recovered electroconductive metallic substrate was observed.

Since, in the present invention, an electrophotographic photoreceptor is treated with an aqueous solution of sodium sulfide or sodium thiourea, the treatment is accomplished safely and quickly without causing pollution of the environment. Moreover, an amorphous selenium-containing photosensitive layer can completely be removed from an electroconductive metallic substrate, and thereby the recovered electroconductive metallic substrate is not deformed, and the surface thereof is not roughened by corrosion. Accordingly, the recovered electroconductive metallic substrate can be reused as it is, in preparation of a new electrophotographic photoreceptor, without remachining.

While the invention has been described in detail and with reference to specific embodiments thereof, it will be apparent to one skilled in the art that various changes and modifications can be made therein without departing from the spirit and scope thereof.

What is claimed:

1. A method for removing an amorphous selenium-containing photosensitive layer from an electrophotographic photoreceptor comprising an electroconductive metallic substrate having thereon an amorphous selenium-containing photosensitive layer, said method comprising applying an aqueous 5–50 weight percent solution of sodium thiourea at a temperature of 25° C. to 65° C. onto the amorphous selenium-containing photosensitive layer until the amorphous selenium-containing layer is effectively removed from the metallic substrate.

2. The method as claimed in claim 1, wherein the amorphous selenium-containing photosensitive layer is selected from the group consisting of an amorphous selenium layer, an amorphous Se-As alloy layer and an amorphous Se-Te alloy layer.

3. The method as claimed in claim 2, wherein the aqueous solution of sodium thiourea is applied at a temperature of about 60° C.

4. The method as claimed in claim 1, wherein the amorphous selenium-containing photosensitive layer is selected from the group consisting of an amorphous Se-As alloy layer and an amorphous Se-Te alloy layer, and the aqueous solution of sodium thiourea is applied at a temperature of about 60° C.

* * * * *